United States Patent [19]

Hine, Jr.

[11] 4,036,292

[45] July 19, 1977

[54] REFRIGERATION CONDENSER

[75] Inventor: Louis P. Hine, Jr., Pleasanton, Calif.

[73] Assignee: Westinghouse Electric Corporation, Pittsburgh, Pa.

[21] Appl. No.: 624,353

[22] Filed: Oct. 21, 1975

[51] Int. Cl.[2] ..... F24H 3/06; F28F 13/12

[52] U.S. Cl. ..... 165/122; 62/507; 415/121 G; 417/360; 417/369; 417/424

[58] Field of Search ..... 62/428, 450, 455, 506, 62/507, 508; 165/122; 415/121 G; 417/359, 360, 366, 369, 424

[56] References Cited

U.S. PATENT DOCUMENTS

| | | | |
|---|---|---|---|
| 3,612,173 | 10/1971 | Goyal | 165/122 |
| 3,785,168 | 1/1974 | Domingorene | 62/507 X |
| 3,829,250 | 8/1974 | Samson, Jr. | 417/424 |
| 3,865,517 | 2/1975 | Simmons et al. | 417/424 |
| 3,926,537 | 12/1975 | Piper | 417/360 |

FOREIGN PATENT DOCUMENTS

| | | | |
|---|---|---|---|
| 147,243 | 8/1931 | Switzerland | 62/507 |
| 191,935 | 10/1937 | Switzerland | 62/507 |
| 632,765 | 12/1949 | United Kingdom | 62/507 |
| 664,971 | 1/1952 | United Kingdom | 62/455 |

*Primary Examiner*—Ronald C. Capossela
*Attorney, Agent, or Firm*—E. C. Arenz

[57] ABSTRACT

A refrigeration condenser has the fan and motor supported in depending relation from an inverted, cup-shaped member centered in the top wall opening through which condenser air flows, the cup being supported from the perimeter of the opening in the top wall of the condenser housing by radial spokes having outer ends connected to the housing and extending in a substantially straight line inwardly to connections with the cup, so that the weight of the motor and fan is borne in part at least by tension in the spokes.

7 Claims, 3 Drawing Figures

REFRIGERATION CONDENSER

BACKGROUND OF THE INVENTION

1. Field of the Invention

This invention pertains to the art of refrigeration condensers and in particular to fan mounting arrangements.

2. Description of the Prior Art

The invention is particularly well adapted to be applied to a refrigeration condenser unit of the type used in an air conditioning system of the type known as a split system such as is typically used for centrally air conditioning a residence. In such a system the condenser unit is typically located outside the residence and relatively close to the exterior wall where it is sometimes used to stand upon. Such units typically have an opening in the top wall through which air for condensing refrigerant is caused to flow by a motor driven fan in the housing. Accordingly, a grille is usually provided over this opening to provide mechanical protection, and to prevent foreign matter and fingers from being inserted into the rotating fan blades. Most of the prior art condenser units have supported the motor and fan within the housing by structural members attached either to the base of the unit or to the fan orifice. An exception to the base or orifice mounted fan motor is disclosed in U.S. Pat. No. 3,865,517 in which the motor is suspended or supported by motor support members which are arrayed as spokes and which have inner, depending ends attached to the circumference of the fan motor.

Weather protection for the motors of the typical prior art arrangements is provided by either using a totally enclosed motor or, if using an open-type motor, providing plastic rain shields, all of which tend to add to expense.

Another problem experienced with many of the prior art arrangements where the motor and fan are mounted to a structural element separate from that structural element to which the fan orifice ring is connected is that during shipment or mishandling of the condenser unit the orifice ring can be shifted relative to the fan with the resultant misalignment affecting air flow and if severe enough causing mechanical damage during operation.

The present invention aims at improving the mounting arrangement of the fan and motor in a way that increases the strength of the mounting, promotes the maintenance of the original alignment of parts, uses relatively inexpensive parts and assembly procedures and permits the use of an open type motor.

SUMMARY OF THE INVENTION

In accordance with the invention a vertical shaft, open-type motor carrying the fan below the motor is supported in depending relation from an inverted, cup-shaped member in the center of the top opening, the cup-shaped member in turn being supported by substantially straight radial spokes which have their outer ends connected to the perimeter of the fan opening and their inner ends secured to the cup.

The motor is secured to the cup by plastic expanding grommets into selected ventilating apertures around the circumference of the stator shell near the upper end of the motor, which anchor screws passing through the depending flange of the cup and into the grommet. With this arrangement the motor is suspended from the cup in spaced relation at both its circumference and at its upper end so that the passage of ventilating air is assured, and the cup itself is in turn supported by the radial spokes which are in tension between the cup and the perimeter of the top opening.

DRAWING DESCRIPTION

DESCRIPTION OF THE PREFERRED EMBODIMENT

Figure 1:
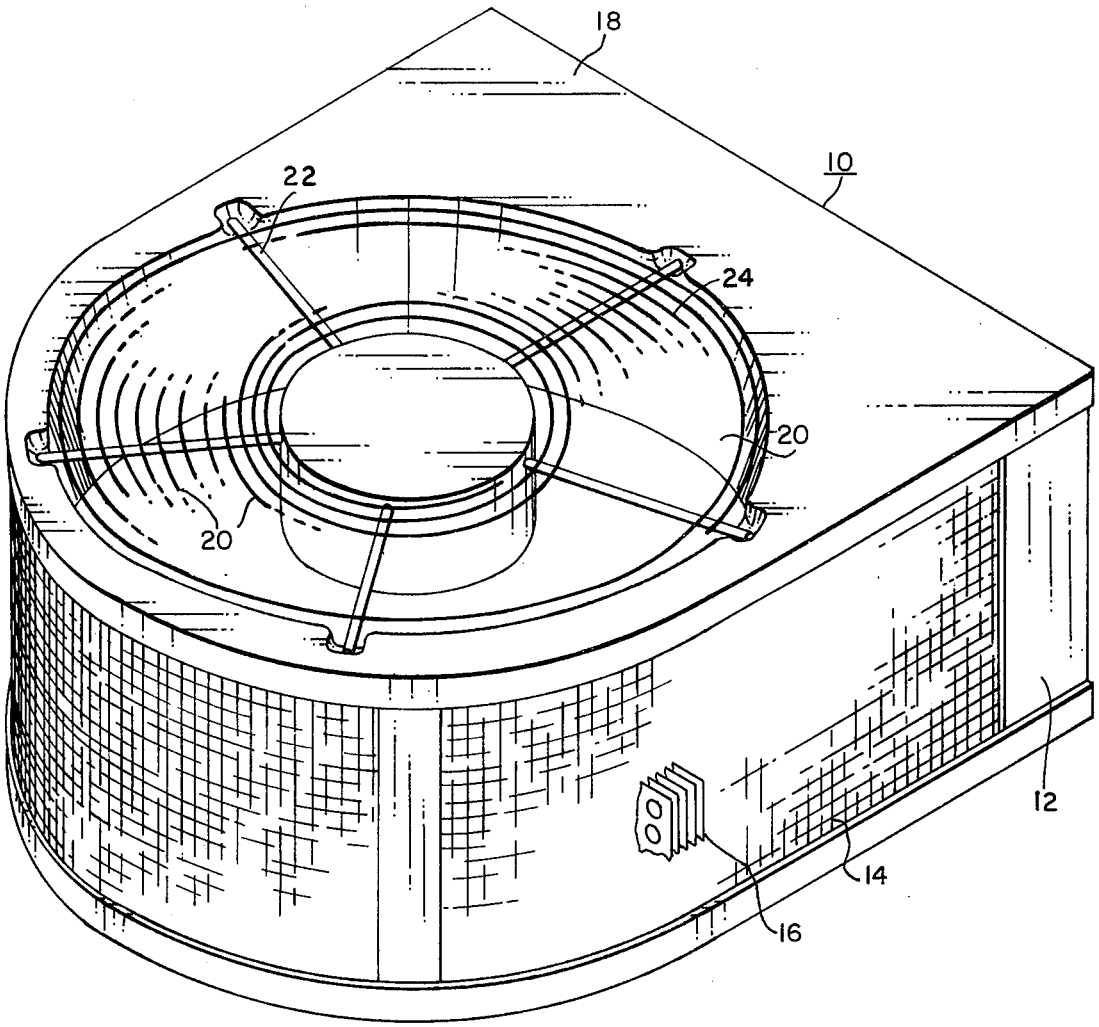
FIG. 1 is an isometric view of a typical refrigeration condenser unit in which the invention is applied.

The refrigeration condenser unit of FIG. 1 includes a housing 10 comprised of side walls 12 open throughout a large part of their extent with an open-work grille 14 in the opening and immediately outward of a condenser coil 16. The top wall 18 is also provided with an opening 20, typically of circular shape and with grille means comprised of radial spokes 22 and a spirally wound wire grille element 24. The housing contains a number of elements which are not shown because they are conventional, such the refrigerant compressor, refrigerant lines and certain electrical elements not of significance in connection with this invention.

Figure 2:
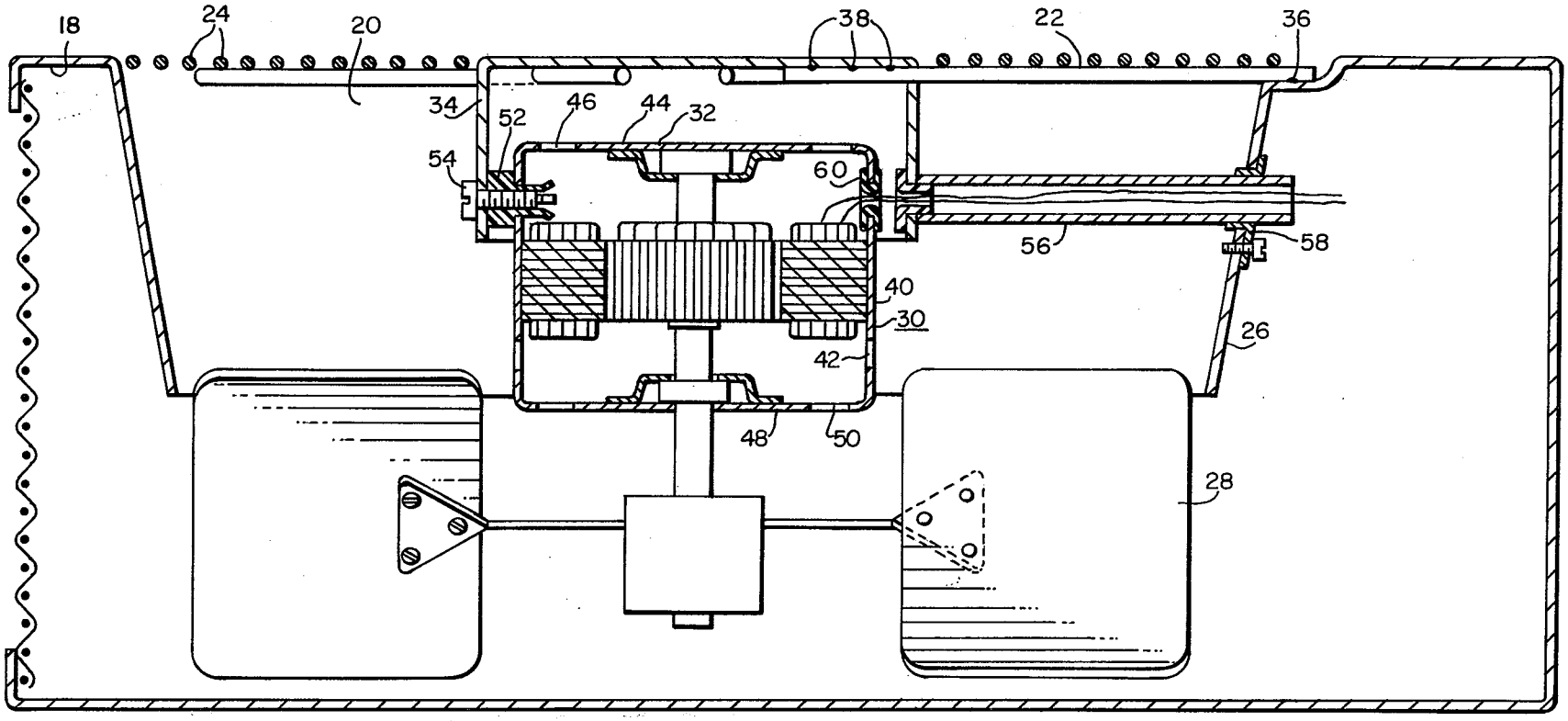
FIG. 2 is a partly diagrammatic, vertical sectional view corresponding to one taken along the line III—III of FIG. 1.

Referring now to FIG. 2 in particular, a circular fan orifice ring 26 is carried from the top wall 18 of the housing (preferably being drawn therefrom) so that, as will be better appreciated hereinafter, the orifice ring is integral with the same supporting structure as the fan 28 in the ring, and the fan motor 30.

In the preferred embodiment of the invention, the central member in the top opening is drawn, cup-shaped member disposed in inverted position to provide a top, imperforate circular part 32 and a depending rim 34. The radial spokes 22 have their outer ends secured to the top wall 18 at the periphery of the top opening, as at 36, by spot welding or any other fastening method which will adequately secure the outer ends, and have their inner ends projecting through holes in the rim 34 of the cup and underlying the flat center part 32 of the cup to which they are also spot welded or similarly fastened as at 38. The spiral grille 24 overlies the spokes and is secured thereto.

Figure 3:
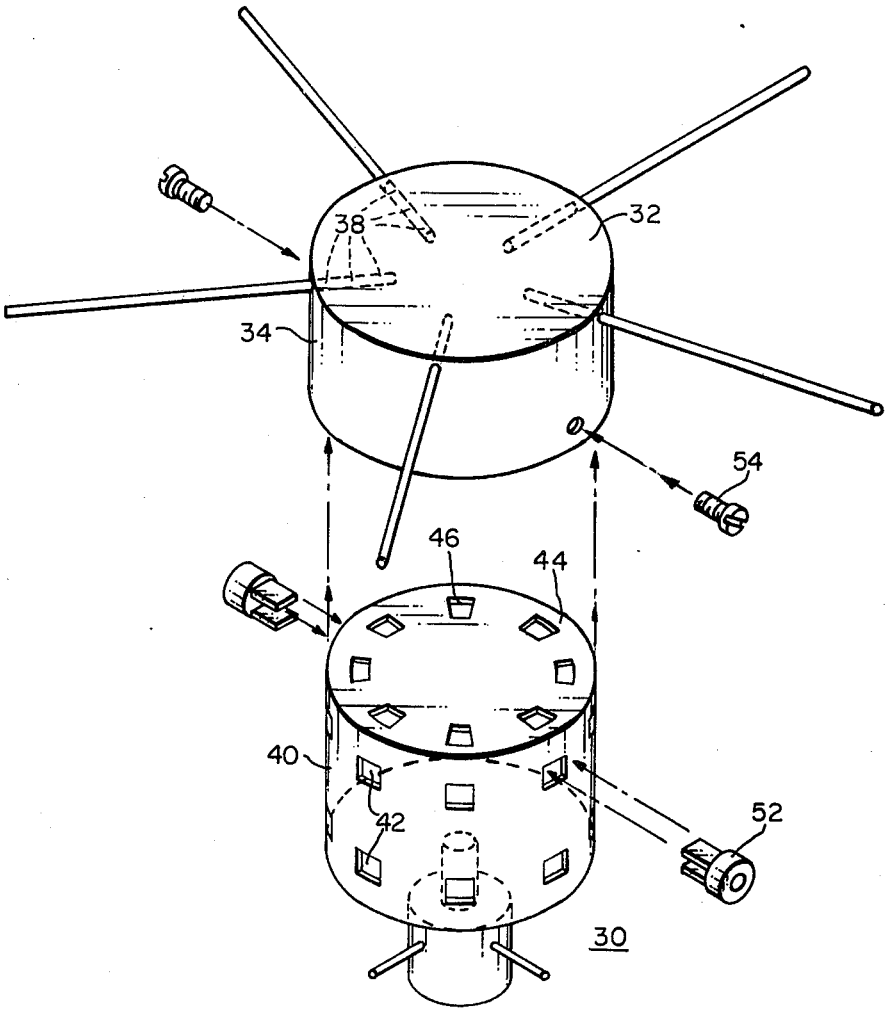
FIG. 3 is an exploded, fragmentary, isometric view of the cup, motor, and associated supporting parts.

The motor 30 (FIGS. 2 and 3) has a cylindrical stator shell 40 with ventilating apertures 42 around the circumference adjacent both ends of the motor and has an upper end bracket or bell 44 with ventilating apertures 46 therein and a similar lower end bell 48 with ventilating apertures 50 therein.

The motor 30 is secured by fastening means to the rim 34 of the cup, the fastening means including a number of plastic expanding grommets 52 (preferably three) and a corresponding number of anchor screws 54. The plastic expanding grommet is a commercially available device which has a split inner end that is basically square in transverse cross section so that it may be inserted into an aperture 42 at the upper end of the stator shell. With three of these grommets equally spaced around the circumference, the motor is located in the cup so that the holes in the rim 34 of the cup are aligned with the grommets and the screws 54 are turned into the grommets to expand the inner ends thereof and secure the motor to the cup. It will be noted that with the assembly as shown in FIG. 2, the top end bell 44 is spaced apart from the under surface of the cup base 32 and the stator shell 40 is also spaced apart inwardly from the rim 34 of the cup. This results in both the upper ventilating apertures 42 being open as well as the ventilating apertures 46 of the top end bell. While the spacing permits ventilation in the area underlying the cup, at the same time the cup provides shielding from driven precipitation into both the top ventilating apertures 46, and the upper side ventilating apertures 42. Any driven moisture which may enter the lower side ventilating apertures 42 tends to pass directly out of the bottom end apertures 50 and thus does not harm the motor.

The described arrangement connecting the motor 30 to the rim 34 is also advantageous in that the grommet plastic material shields the metal anchor screw 54 from the winding in the motor as well as provides torsional resiliency for vibration control. Should the plastic deteriorate or otherwise fail the screw remains to support the motor. The plastic grommet 52 is stressed only in shear by the weight of the motor and is contained in the motor and between the cup and motor by the accurately dimensioning the rim diameter relative to the smaller motor shell diameter. The screw thus in part only locks the plastic grommet into position and provides secondary support if failure of the grommets should occur.

The motor 30 illustrated is a conventional, relatively inexpensive motor in that it is of the open type with cooling occurring by through ventilation through the many apertures. Such motor frame enclosures are sometimes called open air over. As such the motor is significantly less expensive than an enclosed motor which requires greater amounts of steel and copper in the manufacture of the motor.

The mounting arrangement also lends itself to the convenient provision of a motor wire conduit 56 (FIG. 2) which is supported on its inner end in an opening in the rim 34 and at its outer end in an opening in the upper part of the orifice ring 26. Bushing means 58 and 60 are provided at both of the open ends of the tubes to prevent wire chafing on the sharp ends of the tubes and to hold the tube in place.

It will be appreciated that with the arrangement described, wherein the assembly of cup, motor and fan is supported by the spokes which in turn have their outer ends fastened to the same structural elements that the orifice ring depends from, that alignment of the fan with the orifice ring will be maintained even in the event of some distortion or shifting of the top wall relative to the remainder of the housing. Also, and equally important, with the arrangement of the spokes extending in a substantially straight line between the perimeter of the opening to the cup, so that the weight of the central assembly is borne in part at least by the tension in the spokes, any application of a downward force upon the central assembly by someone standing on it or the like will tend to increase the tension in the spokes but without any significant strain in the spokes. Accordingly, there is insignificant downward displacement of the central assembly under the application of a reasonable downward force.

I claim:

1. A refrigeration condenser including:

a housing containing a condenser coil and having side walls and a top wall, said top wall having an opening for the flow of condensing air therethrough;

motor shield and support means in the center of said top wall opening;

a vertical shaft fan motor having an enclosing shell, said shell being supported directly from said motor shield and support means;

a fan secured to said motor shaft below said motor; and a series of radial spokes having their radially outer ends rigidly secured to said housing at the perimeter of said top wall opening and extending in a substantially straight line to said motor shield and support means with their radially inner ends rigidly secured to said motor shield and support means so that the weight of said motor and fan is borne in part at least by tension in said spokes.

2. A condenser according to claim 1 wherein:

said motor shield and support means comprises an inverted, cup-shaped member having a downwardly directed perimetric flange.

3. A condenser according to claim 2 wherein:

said motor includes opposite end bells and is of the open type having ventilating apertures in both end bells, and around the circumference of the motor shell adjacent each end; and said motor is carried by said cup by fastening means extending between the cup wall at least three of said apertures around the circumference at the upper end of said motor, whereby the apertures at the upper end of said motor are shielded by said cup from precipitation.

4. A refrigeration condenser according to claim 3 wherein:

said fastening means includes plastic expanding grommets inserted in selected ones of said ventilation holes, and anchor screws connecting said cup to said grommets and expanding said grommets in said apertures.

5. A refrigeration condenser including:

a housing containing a condenser coil, and having side walls and top wall, said top wall having an opening for the flow of air therethrough;

a fan orifice ring depending from the perimeter of said top wall opening;

an inverted cup-shaped member in the center of said top opening;

a vertical shaft fan motor carried by said cup;

a fan secured to said shaft below said motor and disposed in said orifice ring; and a series of generally horizontal radial spokes having their radially outer ends secured to said housing at the perimeter of said opening and extending in a substantially straight line to said cup-shaped member with their radially inner ends secured to said cup-shaped member whereby the weight of said cup, motor and fan is borne in part by tension in said spokes.

6. A refrigeration condenser according to claim 5 wherein:

said motor is of the open type having ventilating apertures in both ends and around the circumference adjacent both ends; and said motor is resiliently mounted from the rim of said cup-shaped member in inwardly spaced relation from said cup-shaped member and with the ventilating apertures at the upper end of said motor being shielded from weather by said cup-shaped member.

7. A refrigeration condenser according to claim 6 including:

a motor wire conduit extending from said rim of said cup-shaped member to said orifice ring.

* * * * *